US006569263B2

(12) United States Patent
Brown et al.

(10) Patent No.: US 6,569,263 B2
(45) Date of Patent: May 27, 2003

(54) CORROSION PROTECTION

(75) Inventors: Donald W. Brown, Los Alamos, NM (US); Arun S. Wagh, Orland Park, IL (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 09/867,841

(22) Filed: May 29, 2001

(65) Prior Publication Data

US 2002/0179190 A1 Dec. 5, 2002

(51) Int. Cl.[7] ..... C23C 22/07

(52) U.S. Cl. ..... 148/253; 148/262; 148/273; 148/287; 427/419.2; 428/472.3

(58) Field of Search ..... 148/253, 262, 148/273, 287; 427/419.2; 428/472.3

(56) References Cited

U.S. PATENT DOCUMENTS 870,937 A * 11/1907 Coslett ..... 148/241
1,761,186 A * 6/1930 Baker et al. ..... 246/435 R
2,200,615 A * 5/1940 Boyle ..... 148/253
4,615,813 A 10/1986 Bretz ..... 252/8.514
4,721,659 A 1/1988 Tieckelmann et al. ..... 428/701
5,030,285 A 7/1991 Vallvey et al. ..... 106/419
5,279,650 A * 1/1994 Stetson et al. ..... 106/1.12
5,652,064 A 7/1997 Mosser et al. ..... 428/472.3
5,968,240 A 10/1999 Myers et al. ..... 106/14.12
6,084,146 A 7/2000 Barkatt et al. ..... 588/10
6,333,072 B1 * 12/2001 Lane et al. ..... 427/190

OTHER PUBLICATIONS

U.S. patent application Ser. No. 09/510,663, Brown et al., filed Feb. 22, 2000.

* cited by examiner

*Primary Examiner*—John Sheehan
*Assistant Examiner*—Andrew L. Oltmans
(74) *Attorney, Agent, or Firm*—Gemma Morrison Bennett

(57) ABSTRACT

There has been invented a chemically bonded phosphate corrosion protection material and process for application of the corrosion protection material for corrosion prevention. A slurry of iron oxide and phosphoric acid is used to contact a warm surface of iron, steel or other metal to be treated. In the presence of ferrous ions from the iron, steel or other metal, the slurry reacts to form iron phosphates which form grains chemically bonded onto the surface of the steel.

49 Claims, No Drawings

CORROSION PROTECTION

This invention was made with government support under Contracts No. W-7405-ENG-36 and W-31-109-ENG-38 awarded by the U.S. Department of Energy. The government has certain rights in the invention.

TECHNICAL FIELD

This invention relates to a chemically bonded phosphate corrosion protection material and process for application of the corrosion protection material for corrosion prevention.

BACKGROUND ART

There have been developed multifarious paints and paint-like coatings of a large variety of formulations for preventing corrosion of exposed iron or steel structures and surfaces. For example, polymer paints, in particular, provide corrosion protection; however, these coatings often can peel or flake off of metal surfaces, particularly in adverse conditions.

Another approach has involved cladding or brazing an alloy onto the surface of steel or other metal to be protected from corrosion. However, these modifications can be very expensive. This approach necessitates a clean, rust-free surface to which the cladding or brazed alloy will adhere. The material used for cladding or brazing must have a coefficient of thermal expansion similar to that of the material to be protected to prevent delamination or cracking of the coating during thermal cycling. It is also difficult to apply a brazed-on coating to both the inside and outside of a pipe at the same time.

More recently, where safety or environmental considerations have been of paramount importance, corrosion-resistant stainless steels or "super alloys" have been used in applications where prevention of corrosion of steel structures or pipes was absolutely essential. These materials are expensive and more difficult to produce than conventional steel materials.

Therefore there is still a need for economical, efficient corrosion protection methods and materials which can be easily applied and which will reliably adhere to the surface being treated in chemically adverse or saline environments.

It is an object of this invention to provide an efficient corrosion protection method and durable corrosion protection material.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims. The claims appended hereto are intended to cover all changes and modifications within the spirit and scope thereof.

DISCLOSURE OF INVENTION

To achieve the foregoing and other objects, and in accordance with the purposes of the present invention, as embodied and broadly described herein, there has been invented a chemically bondable phosphate corrosion protection material and process for application of the corrosion protection material for corrosion prevention. A slurry of iron oxide and phosphoric acid is used to contact a warm surface of the iron, steel or other metal to be treated. In the presence of ferrous ions from the steel or other metal, the slurry reacts to form iron phosphates as reaction products which chemically bond onto the surface of the steel.

BEST MODES FOR CARRYING OUT THE INVENTION

It has been discovered that surfaces of iron, steel and other metals can be protected from corrosion by weather or adverse chemical conditions by:

(a) combining at least one iron oxide and phosphoric acid to form a slurry;

(b) heating a surface of an article to be protected from corrosion; and (c) contacting the surface with the slurry.

Generally, the surface to be treated does not have to be pre-treated in any way other than being heated. The presence of rust or other contaminants generally will not interfere with successful application of the invention treatment slurry or with permanence of the coating layer formed. However, although the slurry often acts as a detergent on oily surfaces, cleaning the surfaces for chemical reaction, it may be necessary to remove oily contaminants such as lubricants.

The surface of the article to be protected from corrosion can be heated by any suitable means. It can be naturally heated by solar exposure or exposure to warm ambient temperatures. It also may be heated by application of radiant heat, introduction of the article to be protected into a heated chamber or enclosed area, or by submersion into and withdrawal from a warm or hot bath. Alternatively, depending upon the mass heat capacity of the article to be protected from corrosion, the slurry rather than the article to be protected may be heated before application of the slurry to the surface.

Generally, a temperature in the range from about 25° C. to about 40° C. is needed to heat the surface enough to facilitate chemical reaction with the acidic slurry which is applied to the surface. Temperatures above about 110° C. generally should be avoided since such high temperatures would decompose the hydrated iron phosphates which are forming in the slurry and would boil the slurry off.

The iron oxide and phosphoric acid may be combined to form the slurry by any suitable means, such as by incrementally mixing a powder or particulate form of the iron oxide into an aqueous solution of the acid while stirring.

The slurry can be applied by any conventional method used in the painting industry. Suitable means include painting the slurry on with a brush, applying it with a paddle, pouring it onto the surface, dip-coating the surface, or by spraying the surface.

If the source of iron oxide is rust on the surface of an iron, steel or other alloy to be treated, the phosphoric acid is simply applied to the surface to be protected.

The slurry needs to be applied in a layer thick enough to provide complete coverage of the surface to be protected to completely exclude contact of corrosive elements with the surface, and to provide adequate abrasion resistance. The layer should be thin enough to increase liklihood of delamination or to be economically disadvantageous. Generally a layer from about 1 mm to about 2 mm thick provides adequate corrosion protection, depending upon the corrosiveness of the environment to which the surface is to be exposed and the degree of abrasion to be sustained. When the treated surface is to be overcoated with one or more additional layers, different thicknesses of corrosion protection layers may be appropriate.

Oxides of iron which are useful in the practice of the invention are those which will react with the phosphoric acid to form iron phosphates which will chemically bond with iron in the surface of the material being treated. Any of the hydrated, synthetic or natural oxides of iron (ferrous oxide, ferric oxide, ferriferous oxide, or mixtures thereof) can be used in the invention. Presently most preferred are $Fe_3O_4$ (magnetite) and $Fe_2O_3$ (hematite) because of the reactive oxidation states. The oxides of iron which have formed as rust on the surface to be protected may be a sufficient source of iron oxide for practice of the invention.

An amount of iron oxide sufficient to make a paintable slurry is needed. An amount in the range from about 0.5 to about 50 weight percent, based upon total weight of the slurry, is generally useful in the invention. More preferable is an amount of iron oxide in the range from about 10 to about 30 weight percent, based upon total weight of the slurry. Generally presently preferred is an amount of iron oxide in the range from about 20 to about 25 weight percent, based upon total weight of the slurry. Use of too little iron oxide can result in failure of formation of a rigid corrosion protection layer. Use of too much iron oxide can cause poor bonding of the corrosion protection layer to the metal substrate.

A concentration of phosphoric acid sufficient to keep the pH of the slurry below 5 is needed. A concentration in the range from about 10 to about 60 weight percent is generally useful in the invention. More preferable is a concentration of phosphoric acid in the range from about 30 to about 50 weight percent. Generally presently preferred is a concentration of phosphoric acid in the range from about 40 to about 45 weight percent. Use of too dilute phosphoric acid will result in poor acidity and low reactivity of the slurry. Use of too concentrated phosphoric acid can cause too vigorous reactivity of the slurry with the iron, steel or other metal substrate, thereby preventing formation of a stable, uniform coat.

The protective layer can be formed in less than an hour of contact of the slurry with the surface being treated. Contact times in the range from about one-half hour to about 250 hours can be used. It is generally desirable to keep the protective layer free from an abrasive or corrosive atmosphere for a period of time from several hours to several days to allow complete curing of the protective layer.

In the presence of the acidic slurry, or the acidic solution if rust on the surface of the article is relied upon solely as the source of iron oxide, iron from the substrate being treated releases ferric ions ($Fe^{++}$) into the slurry, thereby creating a reducing condition. This results in the reduction of the ferric oxide in the slurry or on the surface of the substrate to ferrous oxide which is even more soluble than the ferric oxide in the acidic slurry or solution. The increase in ferric ions ($Fe^{++}$) in the acidic slurry or solution cause more reactions with the phosphate ions ($H_2PO_4^-$ or $H_2PO_4^{--}$) to form a binder layer of $FeHPO_4$ or $Fe(H_2PO_4)_2$. The total reaction may be written as:

$$Fe_2O_3+Fe+6H_3PO_4+nH_2O=3Fe(H_2PO_4)_2\cdot(n+3)H_2O$$

or $$Fe_2O_3+Fe+3H_3PO_4+nH_2O=3FeHPO_4\cdot(n+3)H_2O$$

wherein n=an integral from 1 to 10

The iron phosphates formed in this reaction form chemical reaction products on the surface of the iron, steel, or other metal being treated. The layers of chemically bonded coating formed in this manner in accordance with the invention are dense and make gas or water permeation through the layer difficult.

When the invention corrosion protection treatment material is applied to steel wellbore casing, bond strengths in the range of 1000 psi or more can be achieved. This compares to a nominal requirement of 70 kPa (100 psi) when conventional wellbore cement is used.

The invention slurry can be tailored to provide optimum protection for whatever material is being treated and the type of corrosive exposure to which the treated material is to be subjected.

For example, compressive or flexural strength of the chemically bonded corrosion protective layers formed in this invention can be enhanced by addition of reinforcing materials such as glass fibers; chopped glass strands; mica; silica; aramids; carbon fibers; alumina; hollow glass or silica spheres; perlite; vermiculite; metal fibers such as aluminum, bronze, zinc, nickel and stainless steel; synthetic organics such as polymer fibers and copolymers; biomaterials such as ground coral; silicate-containing materials such as fly ash; volcanic ash; sand; gravel; other aggregates; and mixtures thereof. The reinforcing or filler materials can be incorporated in the invention slurry prior to application of the invention slurry to the surface of the material to be treated. Or, combined with either the phosphoric acid or the iron oxide prior to combining the phosphoric acid and iron oxide to form the slurry.

Additional treatments or coatings of invention slurries or other coating or treating materials can be applied on top of the invention treatment layer or layers to form an additional protective over-coating or simply an over-coating of a particular color for esthetic purposes. For example, if desired for architectural applications such as iron pillars or decorative structural components, an over-coating of latex paint could be used.

In another example, the treated iron or steel can have a layer of a chemically bonded phosphate ceramic such as magnesium potassium phosphate hexahydrate applied. The magnesium potassium phosphate hexahydrate bonds to the invention treatment layer to form an over-coating with superior strength and wear-resistance. The magnesium potassium phosphate hexahydrate coating is white; alternatively, colorants can be added if needed, for example, for production of colored structural components for architectural applications.

Over-coating materials to be applied on top of the invention treatment material can be reinforced or filled with materials such as those listed as reinforcers or fillers for the invention corrosion protection layers.

Over-coatings of materials which are suitable as substrates for other materials can also be used on top of the invention treatment materials. For example, underwater structures can be reinforced by coral growths which need inorganic substrates. Chemically bonded phosphate ceramic over-coatings such as magnesium potassium phosphate hexahydrate can serve as inorganic substrates that are superior to metal substrates for coral growths, such as might be desired for undersea oil field equipment.

Because the invention slurry reacts with metal substrates to form chemical bonds, the metal substrates can be joined to each other by heating, applying the invention slurry to one or both surfaces, then placing the substrates in contact with each other to form a chemically bonded high-strength joint. Alternatively, other layers of coatings or materials can be used by applying the additional layers as overcoatings on the invention slurry layer prior to placing the substrates in contact with each other.

The invention materials and methods provide a stable chemical modification of the surface of the material being treated as well as encapsulation of the material being treated.

The invention corrosion protection materials have a thermal expansion coefficient approximately the same as that of mild steel ($10\times10^{-6}$/° C. compared to $12\times10^{-6}$/° C. for steel). Therefore, problems with delamination are minimized.

The invention process is inexpensive and uses commercially available starting materials and conventional equipment.

While the compositions, processes and articles of manufacture of this invention have been described in detail for the purpose of illustration, the inventive compositions, processes and articles are not to be construed as limited thereby. This patent is intended to cover all changes and modifications within the spirit and scope thereof.

INDUSTRIAL APPLICABILITY

The invention materials and method can be used anywhere there is a need to protect steel or iron structures such as bridges, structural supports, pipelines, ocean-going vessels, vehicles or other conveyances, and construction equipment. The invention materials and methods are particularly useful for corrosion protection of equipment and structures used in the petroleum industry, both on- and off-shore.

What is claimed is:

1. A method for providing corrosion protection comprising:

(a) combining at least one iron oxide and phosphoric acid to form a slurry;

(b) heating a surface of an article to be protected from corrosion to a temperature in the range of from about 25° C. to about 100° C.; and (c) contacting said surface with said slurry to form a layer of said slurry on said surface.

2. The method recited in claim 1 wherein said surface is contacted by said slurry by a method selected from the group consisting of: painting said slurry on said surface with a brush; applying said slurry to said surface with a paddle; pouring said slurry onto said surface; dip-coating said surface into said slurry; and spraying said surface with said slurry.

3. The method recited in claim 1 wherein said iron oxide is present in an amount in the range from about 0.5 to about 50 weight percent based on total weight of the slurry.

4. The method recited in claim 1 wherein said phosphoric acid has a concentration in the range from about 10 to about 50 weight percent.

5. The method recited in claim 1 wherein said slurry is in contact with said surface for a period of time in the range from about 1/2 hour to about 250 hours.

6. The method recited in claim 1 further comprising:

(d) allowing said slurry in contact with said surface to set up into a first layer upon said surface; and (e) applying a second layer on top of the first layer.

7. The method recited in claim 6 wherein said second layer is another layer of said slurry.

8. The method recited in claim 6 wherein said second layer is a material other than said slurry.

9. The method recited in claim 6 wherein said second layer is a ceramic phosphate.

10. The method recited in claim 6 wherein said second layer is a latex paint.

11. The method recited in claim 6 wherein the second layer further comprises at least one reinforcing material.

12. The method recited in claim 11 wherein said reinforcing material is one selected from the group consisting of glass fibers; chopped glass strands; mica; silica; aramids; carbon fibers; alumina; hollow glass or silica spheres; perlite; vermiculite; metal fibers comprising aluminum, bronze, zinc, nickel or stainless steel; synthetic organics comprising polymer fibers and copolymers; biomaterials comprising ground coral; silicate-containing materials comprising fly ash; volcanic ash; sand; gravel; and mixtures thereof.

13. The method recited in claim 1 wherein the slurry further comprises at least one reinforcing material.

14. The method recited in claim 13 wherein said reinforcing material is one selected from the group consisting of glass fibers; chopped glass strands; mica; silica; aramids; carbon fibers; alumina; hollow glass or silica spheres; perlite; vermiculite; metal fibers comprising aluminum, bronze, zinc, nickel or stainless steel; synthetic organics comprising polymer fibers and copolymers; biomaterials comprising ground coral; silicate-containing materials comprising fly ash; volcanic ash; sand; gravel; and mixtures thereof.

15. The layer produced by the method of claim 1.

16. A method for providing corrosion protection comprising:

(a) heating a surface having oxides of iron thereon to a temperature in the range of from about 25° C. to about 10° C.; and (b) contacting said surface having oxides of iron thereon with phosphoric acid.

17. The method recited in claim 16 wherein said surface is contacted by said phosphoric acid by a method selected from the group consisting of: painting said acid on said surface with a brush; applying said acid to said surface with a paddle; pouring said acid onto said surface; dip-coating said surface into said acid; and spraying said surface with said acid.

18. The method recited in claim 16 wherein said iron oxide is present in an amount sufficient to result in the range from about 0.5 to about 50 percent iron oxide, based upon total weight of a slurry forming from reaction of said phosphoric acid with said iron oxide.

19. The method recited in claim 16 wherein said phosphoric acid is in contact with said surface for a period of time in the range from about 1/2 hour to about 250 hours.

20. The method recited in claim 16 further comprising:

(c) allowing said phosphoric acid in contact with said surface to set up into a first layer upon said surface; and (d) applying a second layer on top of the first layer.

21. The method recited in claim 20 wherein said second layer is another layer comprising phosphoric acid.

22. The method recited in claim 20 wherein said second layer comprises a material other than phosphoric acid.

23. The method recited in claim 20 wherein said second layer is a ceramic phosphate.

24. The method recited in claim 20 wherein said second layer is a latex paint.

25. The method recited in claim 20 wherein the second layer further comprises at least one reinforcing material.

26. The method recited in claim 25 wherein said reinforcing material is one selected from the group consisting of glass fibers; chopped glass strands; mica; silica; aramids; carbon fibers; alumina; hollow glass or silica spheres; perlite; vermiculite; metal fibers comprising aluminum, bronze, zinc, nickel or stainless steel; synthetic organics comprising polymer fibers and copolymers; biomaterials comprising ground coral; silicate-containing materials comprising fly ash; volcanic ash; sand; gravel; and mixtures thereof.

27. The method recited in claim 16 wherein the phosphoric further comprises at least one reinforcing material.

28. The method recited in claim 27 wherein said reinforcing material is one selected from the group consisting of glass fibers; chopped glass strands; mica; silica; aramids; carbon fibers; alumina; hollow glass or silica spheres; perlite; vermiculite; metal fibers comprising aluminum, bronze, zinc, nickel or stainless steel; synthetic organics comprising polymer fibers and copolymers; biomaterials comprising ground coral; silicate-containing materials comprising fly ash; volcanic ash; sand; gravel; and mixtures thereof.

29. The layer produced by the method of claim 16.

30. The method recited in claim 16 wherein said phosphoric acid has a concentration in the range from about 10 to about 50 weight percent.

31. A method for providing corrosion protection comprising:

(a) combining at least one iron oxide and phosphoric acid to form a slurry;

(b) heating said slurry; and (c) contacting a surface of an article to be protected from corrosion with said slurry to form a layer of said slurry comprising a thickness of from about 1 mm to about 2 mm on said surface.

32. The method recited in claim 31 wherein the iron oxide is present in an amount in the range from about 0.5 to about 50 weight percent, based upon total weight of said slurry.

33. The method recited in claim 31 wherein said phosphoric acid has a concentration in the range from about 10 to about 50 weight percent.

34. The method recited in claim 31 wherein said slurry is in contact with said surface for a period of time in the range from about 1/2 hour to about 250 hours.

35. The method recited in claim 31 further comprising:

(d) allowing said slurry in contact with said surface to set up into a first layer upon said surface; and (e) applying a second layer on top of the first layer.

36. The method recited in claim 35 wherein said second layer is another layer of said slurry.

37. The method recited in claim 35 wherein said second layer is a material other than said slurry.

38. The method recited in claim 35 wherein said second layer is a ceramic phosphate.

39. The method recited in claim 35 wherein said second layer is a latex paint.

40. The method as recited in claim 35 wherein the second layer further comprises at least one reinforcing material.

41. The method recited in claim 40 wherein said reinforcing material is one selected from the group consisting of glass fibers; chopped glass strands; mica; silica; aramids; carbon fibers; alumina; hollow glass or silica spheres; perlite; vermiculite; metal fibers comprising aluminum, bronze, zinc, nickel or stainless steel; synthetic organics comprising polymer fibers and copolymers; biomaterials comprising ground coral; silicate-containing materials comprising fly ash; volcanic ash; sand; gravel; and mixtures thereof.

42. The method recited in claim 31 wherein the slurry further comprises at least one reinforcing material.

43. The method recited in claim 42 wherein said reinforcing material is one selected from the group consisting of glass fibers; chopped glass strands; mica; silica; aramids; carbon fibers; alumina; hollow glass or silica spheres; perlite; vermiculite; metal fibers comprising aluminum, bronze, zinc, nickel or stainless steel; synthetic organics comprising polymer fibers and copolymers; biomaterials comprising ground coral; silicate-containing materials comprising fly ash; volcanic ash; sand; gravel; and mixtures thereof.

44. The layer produced by the method of claim 31.

45. A method for providing corrosion protection comprising:

(a) combining at least one iron oxide and phosphoric acid to form a slurry;

(b) heating a first surface of an article to be protected from corrosion;

(c) contacting said surface with said slurry to form a layer of said slurry on said surface;

(d) heating a second surface of a second article to be protected from corrosion;

(e) contacting said second surface with said slurry to form a layer of said slurry on said surface; and (f) placing said first surface in contact with said second surface, thereby forming a bond between said first surface and said second surface.

46. A method for providing corrosion protection comprising:

(a) combining at least one iron oxide and phosphoric acid to form a slurry;

(b) heating said slurry;

(c) contacting a first surface of an article to be protected from corrosion with said slurry to form a layer of said slurry on said surface;

(d) contacting a second surface of an article with said slurry to form a layer of said slurry on said second surface; and (e) placing said first surface in contact with said second surface, thereby forming a bond between said first surface and said second surface.

47. A method for providing corrosion protection comprising:

(a) heating a first surface having oxides of iron thereon;

(b) contacting said surface having oxides thereon with phosphoric acid;

(c) heating a second surface of a second article to be protected from corrosion;

(d) contacting said second surface with said phosphoric acid to form a layer of said slurry on said second surface; and (e) placing said first surface in contact with said second surface, thereby forming a bond between said first surface and said second surface.

48. A method for providing corrosion protection comprising:

(a) heating a surface having oxides of iron thereon; and (b) contacting said surface having oxides thereon with phosphoric acid in an amount and viscosity sufficient to form a layer from about 1 mm to about 2 mm in thickness when it reacts with said oxides of iron on said surface.

49. A method for providing corrosion protection comprising:

(a) combining at least one iron oxide and phosphoric acid to form a slurry;

(b) heating a surface of an article to be protected from corrosion; and (c) contacting said surface with said slurry to form a layer comprising a thickness of from about 1 mm to about 2 mm of said slurry on said surface.

* * * * *